US007846870B2

(12) United States Patent
Watanabe et al.

(10) Patent No.: US 7,846,870 B2
(45) Date of Patent: Dec. 7, 2010

(54) HEAT-SENSITIVE RECORDING BODY

(75) Inventors: Kazuo Watanabe, Amagasaki (JP); Keiichi Inubushi, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 1009 days.

(21) Appl. No.: 11/578,790

(22) PCT Filed: Apr. 21, 2005

(86) PCT No.: PCT/JP2005/007620

§ 371 (c)(1),
(2), (4) Date: Oct. 18, 2006

(87) PCT Pub. No.: WO2005/102725

PCT Pub. Date: Nov. 3, 2005

(65) Prior Publication Data

US 2007/0173406 A1 Jul. 26, 2007

(30) Foreign Application Priority Data

Apr. 22, 2004 (JP) ..... 2004-126236

(51) Int. Cl.
*B41M 5/337* (2006.01)

(52) U.S. Cl. ..... 503/214; 503/226

(58) Field of Classification Search ..... None
See application file for complete search history.

(56) References Cited

U.S. PATENT DOCUMENTS

| | | | | |
|---|---|---|---|---|
| 5,210,066 | A | 5/1993 | Sakurai et al. | 503/214 |
| 5,604,176 | A | 2/1997 | Shimizu et al. | 503/207 |
| 2006/0166821 | A1 | 7/2006 | Sakurai et al. | 503/200 |

FOREIGN PATENT DOCUMENTS

| | | | |
|---|---|---|---|
| JP | 49-115554 | A | 11/1974 |
| JP | 54-61542 | A | 5/1979 |
| JP | 4-135786 | A | 5/1992 |
| JP | 5-69665 | A | 3/1993 |
| JP | 6-64322 | A | 3/1994 |
| JP | 6-72025 | A | 3/1994 |
| JP | 6-155916 | A | 6/1994 |
| JP | 6-206376 | A | 7/1994 |
| JP | 6-255265 | A | 9/1994 |
| JP | 6-316156 | A | 11/1994 |
| JP | 6-344668 | A | 12/1994 |
| JP | 7-290821 | A | 11/1995 |
| JP | 8-337057 | A | 12/1996 |
| JP | 9-207435 | A | 8/1997 |
| JP | 10-272839 | A | 10/1998 |
| JP | 11-227336 | A | 8/1999 |
| JP | 2001-277719 | A | 10/2001 |
| JP | 2002-29155 | A | 1/2002 |
| JP | 2003-94806 | A | 4/2003 |
| JP | 2003-320755 | A | 11/2003 |
| JP | 2004-25775 | A | 1/2004 |
| JP | 2004-74531 | A | 3/2004 |
| WO | 2004/016440 | A1 | 2/2004 |

OTHER PUBLICATIONS

Tortorello, Anthony J. et al., "Solubility Parameter Concept in the Design of Polymers for High Performance Coatings", *Journal of Coatings Technology*, vol. 55, No. 696, 1983, pp. 99-109.

*Primary Examiner*—Bruce H Hess
(74) *Attorney, Agent, or Firm*—Kubovcik & Kubovcik

(57) ABSTRACT

A heat-sensitive recording material comprising a substrate and a heat-sensitive recording layer, the heat-sensitive recording layer containing a leuco dye, a developer, and a copolymer resin emulsion, the copolymer resin emulsion comprising a copolymer resin, the copolymer resin (1) containing (i) (meth)acrylonitrile, and (ii) one or more vinyl monomers copolymerizable with (meth)acrylonitrile, and (2) having a solubility parameter of 12.0 or higher, above mentioned vinyl monomers (ii) include at least a carboxyl group-containing vinyl monomer, and said at least a carboxyl group-containing vinyl monomer is 1 to 10 mass % of the total mass of the copolymer resin.

9 Claims, No Drawings

HEAT-SENSITIVE RECORDING BODY

TECHNICAL FIELD

The present invention relates to a heat-sensitive recording material employing a color forming reaction between a leuco dye and a developer.

BACKGROUND ART

Heat-sensitive recording materials, which are well known, employ a color forming reaction between a colorless or lightly-colored leuco dye and an organic or inorganic developer by which both these color developing materials are brought into contact with heat to produce a recorded image.

Such heat-sensitive recording materials are relatively inexpensive, and the recording devices are compact and easily maintained. For these reasons, they are used as recording materials in a broad range of fields such as facsimile systems, computers, and the like.

One of the most important qualities in such heat-sensitive recording materials is water resistance, which prevents a heat-sensitive recording layer from coming off when water comes in contact, and inhibits discoloration of recorded portions by the adhesion of water.

Further, it is demanded that heat-sensitive recording materials should not be occurred with sticking, i.e. have good anti-sticking properties, when used for printing with a printer.

Furthermore, recent expansion of the usage of such recording materials for POS labels, merchandise distribution labels and the like has led to demands that recording materials should have good printability, e.g. ink density (ink receptivity), ink density homogeneity (uniformity of the print), etc.

A known technique for imparting water resistance to heat-sensitive recording layers uses as binders a carboxy group-containing aqueous polymer and an oxazoline group-containing aqueous polymer (see patent document 1). Also known for use as a binder for a heat-sensitive recording layer is a certain amount of a water-dispersible polymeric substance having a softening point of from 150 to 260° C. obtained by polymerizing mainly at least one hydrophobic vinyl monomer having a glass transition temperature of 55° C. or higher in the presence of a polymer latex having a glass transition temperature of 50° C. or lower (see patent document 2). The use of a water-soluble modified polyvinyl acetal resin having specific hydrophilic groups is also known (see patent document 3). It is further known that a polymer emulsion obtained under specific conditions by emulsion polymerizing a monomer containing (meth)acrylonitrile, (meth)acrylic ester and ethylene-unsaturated carboxylic acid can be used as binders (see patent document 4). It is known that 70% or more of the binder used in a heat-sensitive recording layer may be an acrylic ester copolymer (see patent document 5). It is also known that a heat-sensitive recording layer may contain a copolymer of a vinyl monomer having a heterocyclic group with a basic nitrogen atom in its ring with an ethylene-vinyl monomer whose $\alpha,\beta$ double bonds have been saturated (see patent document 6). It is known that a heat-sensitive recording layer may contain an acrylic emulsion and colloidal silica, and further contains an inorganic pigment of a specific particle diameter (patent document 7).

However, these techniques did not always render sufficient water resistance or printability.

For the purpose of improving water resistance, the use of at least one crosslinking agent, such as diols and aldehydes is known (see patent document 8).

However, when a crosslinking agent is used, there are problems in that crosslinking requires a long time, the productivity of the heat-sensitive recording materials is reduced, and/or the like.

To eliminate such problems caused by crosslinking agents and enhance water resistance concurrently, the use of specific copolymer resin emulsions and polyolefin copolymer resin emulsions for a protective layer is known (see patent documents 9 and 10). However, further improvement in properties such as heat-sensitivity, etc., is still demanded.

To enhance water resistance and anti-sticking properties, it is known that a heat-sensitive recording layer may contain emulsion-dispersed stearamide and a complex between colloidal silica and an acrylic polymer or styrene-acrylic polymer (see patent document 11). It is known that a heat-sensitive recording layer may contain as binders casein and a hydrophobic acrylic resin having an average molecular weight of 5 million or greater (see patent document 12). To impart outstanding water resistance and printability, the use as binders of a silicone-modified polyvinyl alcohol and an aqueous graft copolymer of silicone and a polymer containing ethylenically-unsaturated carboxylic acid is known (see patent document 13).

While the water resistance, anti-sticking properties and printability attained by these techniques are satisfactory, further improvement is still desirable.

[Patent document 1] Unexamined Japanese Patent Publication No. 1994-155916

[Patent document 2] Unexamined Japanese Patent Publication No. 1994-206376

[Patent document 3] Unexamined Japanese Patent Publication No. 1994-344668

[Patent document 4] Unexamined Japanese Patent Publication No. 1996-337057

[Patent document 5] Unexamined Japanese Patent Publication No. 2001-277719

[Patent document 6] Unexamined Japanese Patent Publication No. 2003-94806

[Patent document 7] Unexamined Japanese Patent Publication No. 2004-25775

[Patent document 8] Unexamined Japanese Patent Publication No. 2002-29155

[Patent document 9] Unexamined Japanese Patent Publication No. 2004-74531

[Patent document 10] International Patent Publication No. 2004/016440

[Patent document 11] Unexamined Japanese Patent Publication No. 1997-207435

[Patent document 12] Unexamined Japanese Patent Publication No. 1998-272839

[Patent document 13] Unexamined Japanese Patent Publication No. 1999-227336

DISCLOSURE OF THE INVENTION

Problems to be Solved by the Invention

An object of the present invention is to provide a heat-sensitive recording material having good water resistance, printability, anti-sticking properties, recording sensitivity, and the like, that can be advantageously used in various fields.

Means to Solve the Problems

The present inventors have conducted extensive research with the primary purpose of eliminating the previously described problems, and found that water resistance, etc., of a heat-sensitive recording material is improved when a copolymer resin emulsion having specific properties is used for a heat-sensitive recording layer. The present inventors conducted further study, whereby the present invention has been accomplished.

That is, the present invention relates to the following heat-sensitive recording materials.

Item 1: A heat-sensitive recording material comprising a substrate and a heat-sensitive recording layer, the heat-sensitive recording layer containing a leuco dye, a developer, and a copolymer resin emulsion, the copolymer resin emulsion comprising a copolymer resin, the copolymer resin (1) containing (i) (meth)acrylonitrile, and (ii) one or more vinyl monomers copolymerizable with (meth)acrylonitrile, and (2) having a solubility parameter of 12.0 or higher, above mentioned vinyl monomers (ii) include at least a carboxyl group-containing vinyl monomer, and said at least a carboxyl group-containing vinyl monomer is 1 to 10 mass % of the total mass of the copolymer resin.

Item 2: A heat-sensitive recording material of Item 1, wherein the glass transition temperature of the copolymer resin that is a component of the copolymer resin emulsion is exceeding 30° C. but equal to or less than 100° C.; and preferably the heat-sensitive recording material comprises a substrate and a heat-sensitive recording layer, the heat-sensitive recording layer containing a leuco dye, a developer, and a copolymer resin emulsion, the copolymer resin emulsion comprising a copolymer resin, the copolymer resin (1) containing (i) (meth)acrylonitrile, and (ii) one or more vinyl monomers copolymerizable with (meth)acrylonitrile, (2) having a solubility parameter of 12.0 or higher, and (3) having the glass transition temperature of exceeding 30° C. but equal to or less than 100° C., above mentioned vinyl monomers (ii) include at least a carboxyl group-containing vinyl monomer, and said at least a carboxyl group-containing vinyl monomer is 1 to 10 mass % of the total mass of the copolymer resin.

Item 3: A heat-sensitive recording material of item 1 or 2, wherein the solids content of the copolymer resin emulsion after drying is 10 to 50 mass % of the entire solids content of the heat-sensitive recording layer.

Item 4: A heat-sensitive recording material of any one of items 1 to 3, wherein the heat-sensitive recording layer further comprises a polyvinyl alcohol with a polymerization degree of 1000 or higher.

Item 5: A heat-sensitive recording material of item 4, wherein the polyvinyl alcohol is a silicone-modified polyvinyl alcohol.

Item 6: A heat-sensitive recording material of item 4 or 5, wherein the polyvinyl alcohol is 1 to 10 mass % of the entire solids content of the heat-sensitive recording layer.

Item 7: A heat-sensitive recording material of any one of items 1 to 6, wherein the heat-sensitive recording layer further comprises a polyolefin polymer resin emulsion contained in a solids content after drying of 0.5 to 15 mass % of the entire solids content of the heat-sensitive recording layer.

Item 8: A heat-sensitive recording material of item 7, wherein the polyolefin polymer resin constituent of the polyolefin polymer resin emulsion has a melting point of 70° C. or higher.

Item 9: A heat-sensitive recording material of any one of items 1 to 8, wherein the heat-sensitive recording layer does not contain any crosslinking agent; and preferably the heat-sensitive recording material of any one of items 1 to 8 comprises a substrate and a heat-sensitive recording layer, the heat-sensitive recording layer containing a leuco dye, a developer, and a copolymer resin emulsion, but no crosslinking agent, the copolymer resin emulsion comprising a copolymer resin, the copolymer resin (1) containing (i) (meth)acrylonitrile, and (ii) one or more vinyl monomers copolymerizable with (meth)acrylonitrile, and (2) having a solubility parameter of 12.0 or higher, above mentioned vinyl monomers (ii) include at least a carboxyl group-containing vinyl monomer, and said at least a carboxyl group-containing vinyl monomer is 1 to 10 mass % of the total mass of the copolymer resin.

Item 10: A heat-sensitive recording material of any one of items 1 to 9, wherein/on no protective layer is provided, and preferably the heat-sensitive recording material of any one of items 1 to 9 comprises a substrate and a heat-sensitive recording layer, but no protective layer, the heat-sensitive recording layer containing a leuco dye, a developer, and a copolymer resin emulsion, the copolymer resin emulsion comprising a copolymer resin, the copolymer resin (1) containing (i) (meth)acrylonitrile, and (ii) one or more vinyl monomers copolymerizable with (meth)acrylonitrile, and (2) having a solubility parameter of 12.0 or higher, above mentioned vinyl monomers (ii) include at least a carboxyl group-containing vinyl monomer, and said at least a carboxyl group-containing vinyl monomer is 1 to 10 mass % of the total mass of the copolymer resin.

Effects of the Invention

The present invention has enabled the obtainment of heat-sensitive recording materials that have good water resistance, printability, anti-sticking properties and anti-scuffing properties, and that further have high productivity with outstanding recording sensitivity.

Heat-sensitive recording materials of the present invention have the above-mentioned remarkable properties even when no protective layer is provided or crosslinking agent is used. More specifically, heat-sensitive recording materials of the present invention have significant water resistance, printability, anti-sticking properties and anti-scuffing properties, and further also have good recording sensitivity even when a protective layer is not provided and/or no crosslinking agent is used.

Heat-sensitive recording materials of the present invention can obviate the need for a protective layer coating step, and can dispense with the time required for crosslinking and heat treatment, thereby leading to high productivity.

Heat-sensitive recording materials of the present invention having such advantages can be widely used as various information recording materials in facsimile system, output devices for computers, output machines for label printers and the like, vending machines, CD/ATM, output devices for order slips used at family restaurants, data output devices for scientific research equipment, etc., and can hence advantageously be used in various industrial fields.

BEST MODE FOR CARRYING OUT THE PRESENT INVENTION

The present invention is described in further details below.

In the specification and claims, the expression "(meth) acrylonitrile" means acrylonitrile and/or methacrylonitrile. The expression "(meth)acrilyc acid ester" means an acrylic acid ester and/or methacrylic acid ester such as methyl acrylate and/or methyl methacrylate.

Copolymer Resin Emulsion

The heat-sensitive recording layer of the heat-sensitive recording material of the present invention uses as a primary binder an emulsion of a copolymer resin having the following characteristics.

The copolymer resin contains as copolymer components, (i) (meth)acrylonitrile, and (ii) one or more vinyl monomers compolymerizable with (meth)acrylonitrile;

has a solubility parameter of 12.0 or higher;

above mentioned vinyl monomers copolymerizable with (meth)acrylonitrile include at least a carboxy group-containing vinyl monomer; and the carboxy group-containing vinyl monomer is 1 to 10 mass % of the total mass of the copolymer resin.

A heat-sensitive recording material of sufficient quality without a protective layer can be obtained by using a copolymer resin emulsion meeting the above requirements as a binder for a heat-sensitive recording layer.

Such a heat-sensitive recording material has particularly good water resistance, printability, anti-sticking properties, recording sensitivity, etc., and has waterproof property when subjected to offset printing. In other words, the thus obtained heat-sensitive recording material is free from such problems as the area adhered by water does not repel ink, so-called non-image area is affected, and failing to form clear image area, etc.

Copolymer Resin Components

The copolymer resin used in the present invention as a constituent of the copolymer resin emulsion comprises as copolymer components (i) (meth)acrylonitrile, and (ii) one or more vinyl monomers copolymerizable with (meth)acrylonitrile.

(i) (Meth)acrylonitrile

The proportion of (meth)acrylonitrile in the copolymer resin is not limited so long as it is in a range in which effects of the present invention are attained, and is preferably about 20 to about 80 mass %, and more preferably about 30 to about 70 mass %. When the (meth)acrylonitrile content is 20 mass % or higher, sufficient water resistant is achieved without affecting anti-sticking properties. When the (meth)acrylonitrile content is 80 mass % or less, production (polymerization) stability of the emulsion is not likely to be impaired and the Tg of the copolymer resin does not become unnecessarily high. Film formability and bonding ability to fillers, etc. of the emulsion are not substantially affected.

(ii) Vinyl monomers copolymerizable with (meth)acrylonitrile

Examples of vinyl monomers copolymerizable with (meth)acrylonitrile include one or more monomers in combination selected from the group consisting of:

(i) carboxyl group-containing vinyl monomers, (ii) methyl (meth)acrylate, ethyl (meth)acrylate, butyl (meth) acrylate, 2-ethylhexyl methacrylate, lauryl (meth)acrylate, and like alkyl (meth)acrylates; and 2-hydroxyethyl (meth) acrylate, 2-hydroxypropyl (meth)acrylate, 2-hydroxybutyl (meth)acrylate, 2-aminoethyl (meth)acrylate, 2-(N-methylamino)ethyl (meth)acrylate, 2-(N,N-dimethylamino) ethyl (meth)acrylate, glycidyl (meth)acrylate, and like (meth)acrylic acid esters, (iii) vinyl acetate, vinyl propionate, and like vinyl esters, (iv) styrene, α-methyl styrene, divinylbenzene, and like aromatic vinyl monomers, (v) (meth)acrylamide, and N-methylol (meth)acrylamide and like N-substituted unsaturated carboxylic acid amides, (vi) vinyl pyrrolidone and like heterocyclic vinyl compounds, (vii) vinylidene chloride, vinylidene fluoride, and like halogenated vinylidene compounds, (viii) ethylene, propylene and like α-olefins, and (ix) butadiene and like dienes.

The content of such vinyl monomers copolymerizable with (meth)acrylonitrile in the copolymer resin is not limited as long as a range thereof can provide the effects of the present invention, and is preferably about 80 to about 20 mass %, and more preferably about 70 to about 30 mass %.

When the vinyl monomer content copolymerizable with (meth)acrylonitrile is 20 mass % or more, emulsion production (polymerization) stability is unlikely to be deteriorated, and the Tg of the copolymer resin does not become unnecessarily high. Film formability and binding ability to fillers, etc. of the emulsion are not substantially affected. When the vinyl monomer content is 80 mass % or less, adequate water resistance can be achieved, and anti-sticking properties are not hindered.

The vinyl monomer copolymerizable with (meta)acrylonitrile of the present invention comprises at least one vinyl monomer containing one or more carboxyl groups.

Examples of such carboxyl group-containing vinyl monomers include one or more monomers in combination selected from the group consisting of acrylic acid, methacrylic acid, crotonic acid, and like ethylenically-unsaturated monocarboxylates; and itaconic acid, maleic acid, fumaric acid, and like ethylenically-unsaturated dicarboxylates and monoalkyl esters thereof.

In the copolymer resin of the present invention, a carboxy group-containing vinyl monomer is essential to ensure polymerization stability of copolymer resin in the preparation of the copolymer resin emulsion, and in addition, the vinyl monomer when neutralized with a base after polymerization hydrates and softens the resin particle surface layer, thereby effectively enhancing film formability of the copolymer resin emulsion. Further, the vinyl monomer functions to increase dispersibility and bonding ability of various optionally added fillers. Furthermore, the carboxyl group acts as a reactive group with a crosslinking agent optionally used in combination.

The carboxyl group-containing vinyl monomer proportion is preferably within the range of from 1 to 10 mass %, and more preferably from 2 to 8 mass %, of the total mass of the copolymer resin.

When the carboxyl group-containing vinyl monomer content is 1 mass % or greater, polymerization stability of the copolymer resin is not impaired and the resin particles are softened when neutralized, leading to good film formability of the copolymer resin emulsion. When the carboxyl group-containing vinyl monomer content is 10 mass % or less, the heat-sensitive recording layer has satisfactory water resistance, being free from gelation caused by dissolution of resin particles during neutralization.

Solubility Parameter

In the present invention, the solubility parameter of the copolymer resin constituting the copolymer resin emulsion is 12.0 or higher. The solubility parameter is described in, for example, Iwanami Rikagaku Jiten, the 4th edition.

A solubility parameter of 12.0 or higher improves heat-resistance to heat from a thermal head when in use (adhesiveness to the thermal head), resulting in increased inner cohesion of the resin.

With a solubility parameter less than 12.0, causing inadequate inner cohesion of the resin, the heat-sensitive recording layer tends to soften easily due to its increased temperature sensitivity and thereby affecting running stability to the thermal head.

The solubility parameter has no upper limit, but a range 14.0 or less is preferable in light of properties and industrial production efficiency of the copolymer resin used in the invention.

When a solubility parameter is 14.0 or less, the copolymer resin has not an increased hydrophilicity and is substantially free from impaired water resistance, and the production of the copolymer resin emulsion becomes easier.

The solubility parameter used in the invention is a value calculated based on the total energy of vaporization generated by the molecular structure and atomic groups of each copolymerization component, and the molar volume ratio of the copolymerization components.

The solubility parameter can be calculated using the following formula 1 in accordance with the *Journal of Technology Coatings*, VOL. 55, No. 696, pp 100-101.

$$\delta=[(\Sigma\Delta e_i)(X)/(\Sigma\Delta v_i)(X)]^{0.5} \quad \text{[Formula 1]}$$

($\delta$: solubility parameter, X: molar fraction of monomer used in copolymerization, $\Delta e_i$: energy of vaporization of each monomer, and $\Delta v_i$: molar volume)

A copolymer resin having such a specific solubility parameter can be prepared by suitably selecting monomers for copolymerization and the proportions of such monomers.

Other Properties of Copolymer Resin Emulsion

The average primary particle diameter (number average particle diameter by dynamic light scattering method, measuring equipment: trade name, LPA3100; manufactured by OTSUKA ELECTRONICS, CO., LTD.) of the copolymer resin emulsion is not limited, but is preferably about 50 to about 500 nm, and more preferably about 70 to about 300 nm.

The emulsion viscosity is not significantly increased when the average particle diameter is 50 nm or higher. Consequently, it is cost effective because there is no need to reduce the resin density during its production, thereby allowing drying the coating composition of the heat-sensitive recording layer without delay, whereby the productivity of the heat-sensitive recording material is not impaired, etc. In contrast, when the average particle diameter is 500 nm or less, the surface of the heat-sensitive recording layer becomes dense and desired effects are likely to be obtained.

The average particle diameter can be easily adjusted according to the knowledge of persons skilled in the art, and it can be adjusted, for example, by suitably selecting the composition of starting monomers and type of surfactants for the copolymer resin emulsion.

The glass transition temperature of the copolymer resin that is a constituent of the copolymer resin emulsion is preferably exceeding 30° C. but equal to or less than 100° C., and more preferably exceeding 30° C. but equal to or less than 70° C.

A glass transition temperature exceeding 30° C. gives good heat-resistance, and a glass transition temperature 100° C. or less does not cause inconvenient impaired film formability. As a result, good water-resistance, printability and anti-sticking properties are provided.

In the present invention, since the solubility parameter for the copolymer resin emulsion as a binder is set to 12.0 or higher, the binding ability of the emulsion is not diminished even when the copolymer resin has a glass transition temperature exceeding 30° C.

A heat-sensitive recording material having outstanding heat-resistance, remarkable water resistance, printability, and like capabilities can be obtained by setting the solubility parameter and glass transition temperature of the copolymer resin emulsion contained in the heat-sensitive recording layer.

Method for Producing Copolymer Resin Emulsion

The above-mentioned copolymer resin emulsion can be, for example, produced by the method disclosed in International Patent Publication No. 2004/016440.

In the process of producing the copolymer resin emulsion, an emulsifier can be used as necessary to impart emulsion stability.

For example, usable are one or more emulsifiers selected from the group consisting of anionic surfactants such as sulfuric acid esters of higher alcohols, alkyl benzene sulfonates, aliphatic sulfonates, alkyl diphenyl ether sulfonates, etc.; and nonionic surfactants such as alkylester-type-, alkylphenyl ether-type-, alkyl ether-type-polyethyleneglycol, etc.

The amount of such emulsifiers to be used is not limited, and in light of the water-resistance of the resin the bare minimum amount is preferably used.

A polymerization initiator can be used as necessary in the process of producing the copolymer resin emulsion.

Usable polymerization initiators include water-soluble initiators such as persulfates, hydrogen peroxide, organic hydroperoxides, azobiscyanovaleric acid, etc.; oil-soluble initiators such as azobisisobutyronitrile, benzoyl peroxide, etc.; and redox type initiators combined with a reducing agent. The content of such polymerization initiators to be used is not limited and standard practices can be followed, but is typically about 0.1 to about 10 mass parts, and preferably about 0.1 to about 5 mass parts, per 100 mass parts of vinyl monomer(s).

A molecular weight adjustment agent (chain transfer agent) may further be used as necessary in the process of producing the copolymer resin emulsion. Examples of molecular weight adjustment agents include octyl mercaptan, n-dodecyl mercaptan, t-dodecyl mercaptan, and like mercaptans; low molecule weight halogenated compounds, etc.

The copolymer resin emulsion is neutralized using a base for the preparation. The neutralization agent can be freely selected, but it is preferable to use aqueous ammonia. Since aqueous ammonia is easily removed at a relatively low temperature, water-resistance can be quickly attained after the formation of the heat-sensitive recording layer.

Amount of Copolymer Resin Emulsion

The copolymer resin emulsion is preferably contained on a dry solids basis in about 10 to about 50 mass %, and preferably about 10 to about 30 mass %, of the entire solids content of the heat-sensitive recording layer.

When the copolymer resin emulsion content is 10 mass % or more, sufficient water-resistance and printability can be achieved. When the emulsion content is 50 mass % or less, the proportion of color forming components is not low, and recording sensitivity is therefore unlikely to be affected.

Polyvinyl Alcohol Having a Polymerization Degree of 1000 or Greater

In the present invention, it is preferable that the heat-sensitive recording layer further contain polyvinyl alcohol with a polymerization degree of 1000 or higher.

When the heat-sensitive recording layer contains polyvinyl alcohol with a polymerization degree of 1000 or higher, a heat-sensitive layer subjected to offset printing is not peeled off by ink of high tackiness and the layer does not adhere to the blanket, so that the blanket is further improved against stains and hence printability is enhanced.

Other water-soluble binders may provide the similar effects, however, polyvinyl alcohol is particularly effective in improving printability.

Polyvinyl alcohol with a polymerization degree of 1000 or higher, particularly 1000 to 2500, is very effective in improving the surface strength of the heat-sensitive recording layer. Even a small amount can greatly improve the blanket against stains. Water resistance of the heat-sensitive recording layer surface is barely impaired.

Further, in the heat-sensitive recording layer, the use of polyvinyl alcohol with a polymerization degree of 1000 or higher in combination with the copolymer resin emulsion can prevent the emulsion from separating from other materials of the layer.

Usable types of polyvinyl alcohol include completely saponified polyvinyl alcohol, partially saponified polyvinyl alcohol, carboxy-modified polyvinyl alcohols, acetoacetyl-modified polyvinyl alcohols, diacetone-modified polyvinyl alcohols, silicone-modified polyvinyl alcohols, and the like.

Of these, silicone-modified polyvinyl alcohols are preferable considering their effect in improving water-resistance of the heat-sensitive recording material.

Examples of silicone-modified polyvinyl alcohol that can be used are those disclosed in Unexamined Japanese Patent Publication No.1983-79003.

The preferable proportion of polyvinyl alcohol with a polymerization degree of 1000 or higher contained is about 1 to about 10 mass %, and more preferably about 1 to about 7 mass %, of the total solids amount of heat-sensitive recording layer.

An content over 1 mass % provides good surface strength to the heat-sensitive recording layer, while a content of 10 mass % or less does not affect water resistance.

The heat-sensitive recording layer of the present invention can comprise other water-soluble binders in amounts that do not inhibit the effects attained by the invention.

Examples of such other binders include oxidized starch, esterified starches, etherified starches and like starches; methyl cellulose, carboxymethyl cellulose, methoxy cellulose, hydroxyethyl cellulose and like cellulose resins; styrene-maleic anhydride copolymers and alkali salts thereof, isobutylene-maleic anhydride copolymers, starch-vinyl acetate graft copolymers and alkali salts thereof, casein, gelatin, vinyl acetate resin latexes, urethane resin latexes, styrene-butadiene copolymer latexes, acrylic resin latexes, polyvinyl alcohols other than the above, etc.

Polyolefin Polymer Resin Emulsion

In the present invention, it is preferable that the heat-sensitive recording layer further contains a polyolefin polymer resin emulsion on a dry solids basis of 0.5 to 15 mass %, and particularly 1 to 10 mass %, of the total solids content of the heat-sensitive recording layer.

In the process of printing, the face of the heat-sensitive recording layer may be scuffed when it comes into contact with rollers. However, with a polyolefin polymer resin emulsion further contained as above, the friction coefficient of the heat-sensitive recording layer face can be reduced, enabling the anti-sticking properties and anti-scuffing properties to be further improved.

A polyolefin polymer resin emulsion content of 0.5 mass % or more can provide better anti-sticking properties and anti-scuffing properties. With an emulsion content of 15 mass % or less, hazing occurring in the recorded area is not noticeable and recording sensitivity is barely impaired.

The melting point of the polyolefin polymer resin that is a constituent of the above-mentioned polyolefin polymer resin emulsion is preferably 70° C. or higher.

A melting point of 70° C. or higher barely impairs the anti-sticking properties and abrasive resistance caused by the deformation of resin particles that are constituents of the emulsion on such occasions as when the heat-sensitive recording material is subjected to a supercalendaring surface treatment or the like.

It is preferable that the melting point be 150° C. or lower, and particularly 130° C. or lower. A melting point of 150° C. or lower is unlikely to cause impaired anti-scuffing properties.

The average particle diameter of the polyolefin polymer resin emulsion (50% value, i.e. D50, measured by using a laser diffraction particle size distribution analyzer (tradename: SALD-2000, product of Shimadzu Seisakusho Co.) is preferably about 0.1 to about 10 μm, and particularly about 0.1 to about 6 μm.

An average particle diameter of 0.1 μm or higher is highly effective in improving anti-scuffing properties, whereas with an average particle diameter of 10 μm or less, the sensitivity is unlikely to be impaired by degraded image quality of recorded areas.

Examples of the polyolefin polymer resin that is a component of the polyolefin polymer resin emulsion include polymers and copolymers comprising one or more monomers selected from the group consisting of ethylene, propylene, 1-butene, 3-methyl-1-butene, 4-methyl-1-pentene, 3-methyl-1-pentene, 1-heptene, 1-hexene, 1-octene, 1-decene, 1-dodecene, and like α-olefins.

Of these, resins comprising ethylene, propylene and/or 1-butene as polymerization components are preferable.

In particular, low-molecular weight polyethylene emulsions are preferable.

Leuco Dyes and Developers

Any of various known leuco dyes and developers can be contained in the heat-sensitive recording layer of the present invention. Specific examples of leuco dyes include dyes capable of forming blue color such as 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-diethylamino-7-dibenzyamino-benzo[a] fluoran and the like; dyes capable of forming green color such as 3-(N-ethyl-N-p-tolyl)amino-7-N-methylanilinofluoran, 3-diethylamino-7-anilinofluoran, 3-diethylamino-7-dibenzylaminofluoran and the like; dyes capable of forming red color such as 3-cyclohexylamino-6-chlorofluoran, 3-diethylamino-6-methyl-7-chlorofluoran, 3-diethylamino-6,8-dimethylfluoran and the like; dyes capable of forming black color such as 3-(N-ethyl-N-isopentylamino)-6-methyl-7-anilinofluoran, 3-diethylamino-6-methyl-7-anilinofluoran, 3-diethylamino-6-methyl-7-(o,p-dimethylanilino)fluoran, 3 (N-ethyl-N-p-toluidino)-6-methyl-7-anilinofluoran, 3-pyrrolidino-6-methyl-7-anilinofluoran, 3-di(N-butyl)amino-6-methyl-7-anilinofluoran, 3-(N-cyclohexyl-N-methylamino)-6-methyl-7-anilinofluoran, 3-diethylamino-7-(o-chloroanilino)fluoran, 3-diethylamino-7-(m-trifluoromethylanilino)fluoran, 3-diethylamino-6-methyl-7-chlorofuoran, 3-diethylamino-6-methylfluoran, 3-cyclohexylamino-6-chlorofluoran, 3-(N-ethyl-N-hexylamino)-6-methyl-7-(p-chloroanilino)fluoran, 3-di(N-pentyl)amino-6-methyl-7-anilinofluoran, 3-(N-isoamyl-N-ethylamino)-7-(o-chloroanilino)fluoran, 3-(N-ethyl-N-2-tetrahydrofurfurylamino)-6-methyl-7-anilinofluoran, 3-diethylamino-6-chloro-7-anilinofluoran, 3-(N-n-hexyl-N-ethylamino-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-(N-ethyl-p-toluidino)-6-methyl-7-(p-toluidino)fluoran, 3-piperidino-6-methyl-7-anilinofluoran, 3-diethylamino-7-(o-fluoroanilino) fluoran, 3-(4-dimethylamino)anilino-5,7-dimethylfluoran and the like; dyes having absorption bands in the near infrared region such as 3,3-bis[1-(4-methoxyphenyl)-1-(4-dimethylaminophenyl)ethylene-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, 3,6-bis(dimethylamino)fluoren-9-spiro-3'-(6'-dimethylamino)phthalide and the like. Needless to say, usable dyes are not limited to these examples, and two or more such dyes can be used in combination.

Specific examples of developers include phenolic compounds such as 1,1-bis(4-hydroxyphenyl)-1-phenylethane, 4,4'-dihidroxy-diphenylmethane, 4,4'-isopropylidenediphenol (bisphenol A), hydroquinone, 4,4'-cyclohexylidenebisphenol, 4,4'-(1,3-dimethylbutylidene) bisphenol, 2,2-bis(4-hydroxyphenyl)-4-methylpentane, 4,4'-dihydroxydipheynylsulfide, 4,4-dihydroxydiphenylsulfone, 2,4'-dihydroxydiphenylsulfone, 4-hydroxy-4'-methyldiphenylsulfone, 4-hydroxy-4'-benzyloxydiphenylsulfone, 2,4-bis (phenylsulphonyl)phenol, 2,2'-[4-(4-hydroxyphenylsulphonyl)phenoxy]diethyl ether, 1,3,3-trimethyl-1-(p-hydroxyphenyl)-6-hydroxyindane, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl) sulfones, 1,3-di[2-(4-hydroxyphenyl)-2-propyl]benzene, hydroquinone monobenzyl ether, phenyl 4-hydroxybenzoate, benzyl 4-hydroxybenzoate, tolyl 4-hydroxybenzoate, p-hydroxy-N-(2-phenoxyethyl)benzene sulfonamide, 1,8-bis(4-hydroxyphenylthio)-3,6-dioxaoctane, (4-hydroxyphenylthio)acetic acid 2-(4-hydroxyphenylthio)ethyl ester, Novolac-type phenol resins, phenol polymers and the like; those having —$SO_2$NH— bonds within the molecule such as N-(p-tolylsulfonyl)carbamic acid p-cumylphenyl ester, 4,4'-bis(N-p-tolylsulfonylaminocarbonylamino)diphenylmethane, 4,4'-bis(N-p-tolylsulfonylaminocarbonylamino) diphenylsulfone, N-p-tolylsulfonyl-N'-p-butoxycarbonylphenylurea, N-p-tolylsulfonyl-N'-phenylurea, N-p-tolylsulfonyl-N'-3-(p-tolylsulfonyloxy) phenylurea, and the like; zinc salts of aromatic carboxylic acids, such as zinc p-chlorobenzoate, zinc 4-[2-(p-methoxyphenoxy)ethyloxy]salicylate, zinc 4-[3-(p-tolylsulfonyl) propyloxy]salicylate, zinc 5-[p-(2-p-methoxyphenoxyethoxy)cumyl]salicylate and the like.

Needless to say, developers are not limited to these examples, and two or more such developers can be used in combination.

The ratio of leuco dye and developer to be used is not limited, and can be suitably determined in accordance with the type of leuco dyes and developers used, but is usually about 100 to about 1000 mass parts, and preferably about 100 to about 500 mass parts, of developer per 100 mass part of leuco dyes.

The leuco dye content percentage in the heat-sensitive recording layer is typically about 5 to about 50 mass %, and particularly about 8 to about 30 mass %.

The developer content percentage in the heat-sensitive recording layer is typically about 5 to about 60 mass %, and particularly about 10 to about 50 mass %.

Other Components

The heat-sensitive recording layer may further contain preservability improving agents to enhance preservation stability of recorded images and sensitizers to enhance recording sensitivity.

Specific examples of such preservability improving agents include hindered phenol compounds such as 2,2'-methylenebis(4-methyl-6-tert-butylphenol), 4,4'-thiobis(2-methyl-6-tert-butylphenol), 4,4'-butylidenebis(6-tert-butyl-m-cresol), 1,1,3-tris(2-methyl-4-hydroxy-5-tert-butylphenyl) butane, 1,1,3-tris(2-methyl-4-hydroxy-5-cyclohexylphenyl) butane, 2,2-bis(4-hydroxy-3,5-dibromophenyl)propane, 2,2-bis(4-hydroxy-3,5-dimethylphenyl)propane and the like; and epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl terephthalate, cresol novolac-type epoxy resins, phenol novolac-type epoxy resins, bisphenol A-type epoxy resins and the like. Needless to say, preservability improving agents are not limited to these examples, and two or more such agents can also be used in combination.

The preservability improving agent content is not limited, but the content is generally about 1 to about 40 mass %, and particularly about 2 to about 30 mass %, of the total solids content of the heat-sensitive recording layer.

Specific examples of sensitizers include stearamide, methylenebisstearamide, dibenzyl terephthalate, benzyl p-benzyloxybenzoate, 2-naphthyl benzyl ether, m-terphenyl, p-benzylbiphenyl, p-tolyl biphenyl ether, di(p-methoxyphenoxyethyl)ether, 1,2-di(3-methylphenoxy) ethane, 1,2-di(4-methylphenoxy)ethane, 1,2-di(4-chlorophenoxy)ethane, 1,2-diphenoxyethane, 1-(4-methoxyphenoxy)-2-(3-methylphenoxy)ethane, p-methylthiophenylbenzyl ether, 1,4-di(phenylthio)buthane, p-acetotoluidide, p-acetophenetidide, N-acetoacetyl-p-toluidine, di(β-biphenylethoxy)benzene, p-di(vinyloxyethoxy) benzene, 1-isopropylphenyl-2-phenylethane, oxalic acid di-p-chlorobenzyl ester, oxalic acid di-p-methylbenzyl ester, oxalic acid dibenzyl ester, and the like. Needless to say, usable sensitizers are not limited to these examples, and two or more such sensitizers can also be used in combination.

The sensitizer content is not limited, but is generally about 3 to about 40 mass %, and particularly about 5 to about 30 mass % of the total solids content of the heat-sensitive recording layer.

The heat-sensitive recording layer may further contain various auxiliaries as necessary, such as kaolin, calcium carbonate, amorphous silica, titanium oxide, aluminium hydroxide, calcined kaolin, zinc oxide and like pigments; zinc stearate, calcium stearate and like lubricants; fluorescent dyes; UV absorbents; surfactants; and/or the like.

It is preferable that the heat-sensitive recording layer of the present invention be free of crosslinking agents.

The heat-sensitive recording layer of the present invention has outstanding water resistance, printability, anti-sticking properties, etc., without containing any crosslinking agent. Further, when a crosslinking agent is not used, there is no need to worry about discoloration with time and/or yellowing of the heat-sensitive recording material and high productivity can be achieved because time required for crosslinking and time-consuming of heat treatment becomes unnecessary during the production steps of the heat-sensitive recording material.

Method for Producing Heat-sensitive Recording Layer

The heat-sensitive recording layer may be formed as follows. A leuco dye and developer and, if necessary, sensitizer, preservability improving agent, etc. are pulverized using a dispersant as necessary, typically in water serving as a dispersion medium, either jointly or separately, by means of a ball mill, an attritor, a sand mill or like mixing and pulverizing apparatus, to an average particle diameter of about 2 μm or less. Subsequently, a coating composition for forming a heat-sensitive recording layer is prepared by adding the above-mentioned polymer resin emulsion having a solubility parameter of 12 or higher, and other binders, etc. as necessary. The thus-prepared coating composition is applied to a substrate such that the amount of the coating composition is about 1 to about 15 g/m$^2$ after drying, particularly about 2 to about 10 g/m$^2$, and is dried to form a heat-sensitive recording layer.

The coating method for the coating composition for forming the heat-sensitive recording layer is not limited, and employable examples of known methods include air knife coating, Vari-Bar blade coating, pure blade coating, gravure coating, rod blade coating, short-dwell coating, curtain coating, dye coating, and the like.

Undercoat Layer

In the present invention, an undercoat layer can be provided, if necessary, between the substrate and the heat-sensitive recording layer to increase the recording sensitivity and recording runnability.

Such an undercoat layer may be formed by applying a coating composition for forming an undercoat layer to the substrate and drying the coating composition, the composition comprising as main components a binder and at least one component selected from the group consisting of oil absorbing pigments having an oil absorption of about 70 ml/100 g or more and particularly about 80 to about 150 ml/100 g, hollow organic particles, and thermal expansion particles. Herein, the above oil absorption is a value determined in accordance with the method described in JIS K5101-1991.

Any of various oil absorbing pigments can be used in the above, and specific examples include calcined kaolin, amorphous silica, light calcium carbonate, talc, and like inorganic pigments. It is preferable that the average particle diameter of these oil absorbing pigments (50% value, i.e. D50, measured using a laser diffraction particle size distribution analyzer (tradename: SALD-2000, product of Shimadzu Seisakusho Co.) be preferably about 0.01 to about 5 μm, and particularly about 0.02 to 3 μm.

The amount of oil absorbing pigment used can be selected from a wide rage, and a preferable amount is generally about 50 to about 95 mass %, particularly about 70 to 90 mass %, of the total solids content of the undercoat layer.

Examples of useful hollow organic particles include those heretofore known, such as particles comprising shells made of acrylic resins, styrene resins, vinylidene chloride-based resins, etc., and having a hollowness of about 50 to about 99%. Herein, hollowness denotes the value calculated by the equation (d/D)×100. In this equation, d represents the inside diameter of the hollow organic particle, and D represents the outside diameter of the hollow organic particle. The average particle diameter of the hollow organic particles (50% value, i.e. D50, measured with a laser diffraction particle size distribution analyzer (tradename: SALD-2000, product of Shimadzu Seisakusho Co.) is preferably about 0.5 to about 10 μm, and particularly preferably about 1 to about 3 μm.

The amount of the hollow organic particles used can be selected from a wide range, and it is preferable that such particles generally be about 20 to about 90 mass %, and particularly about 30 to about 70 mass %, of the total solids content of the undercoat layer.

When using an inorganic oil absorbing pigment above in combination with hollow organic particles, it is preferable that the inorganic oil absorbing pigment and hollow organic particles are used in amounts within the above-specified range and that the total amount of inorganic oil absorbing pigment and hollow organic particles is preferably about 40 to about 90 mass %, particularly about 50 to about 80 mass %, of the total solids content of the undercoat layer.

Various kinds of thermal expansion particles can be used, and specific examples include thermal expansion particles that microencapsulate low-boiling hydrocarbons by an insight polymerization method using a copolymer such as vinylidene chloride, acrylonitrile, etc. Low-boiling hydrocarbons are, for example, ethane, propane, and the like.

The amount of such thermal expansion particles used can be selected from a wide range, and it is preferable that the particle be generally used in about 1 to about 80 mass %, particularly about 10 to about 70 mass %, of the total solids amount of the undercoat layer.

Usable binders include those which are used as necessary in the heat-sensitive recording layer, and particularly preferable are starch-vinyl acetate graft copolymers, various polyvinyl alcohols, and styrene-butadiene copolymer latexes.

Examples of usable polyvinyl alcohols include completely saponified polyvinyl alcohol, partially saponified polyvinyl alcohol, carboxy-modified polyvinyl alcohols, acetoacetyl-modified polyvinyl alcohols, diacetone-modified polyvinyl alcohols, silicone-modified polyvinyl alcohols, etc.

The amount of such binders used can be selected from a wide range, and it is generally preferable that they be about 5 to 30 mass %, particularly about 10 to about 25 mass %, of the total solids amount of the undercoat layer.

The amount of coating composition applied for forming the undercoat layer applied is about 3 to about 20 g/m$^2$, and preferably about 5 to about 12 g/m$^2$, on a dry weight basis.

The coating method for the coating composition for forming the undercoat layer is not limited, and examples include heretofore known coating methods such as air knife coating, Vari-Bar blade coating, pure blade coating, gravure coating, rod blade coating, short-dwell coating, curtain coating, dye coating, and the like.

Protective Layer

A protective layer having a binder which has film formability as a principal component may be provided on the heat-sensitive recording layer to the extent that the effects of the invention are not impaired.

Examples of binders include oxidized starch, esterified starches, etherified starches and like starches; methyl cellulose, carboxymethyl cellulose, methoxy cellulose, hydroxyethyl cellulose and like cellulose resins; completely saponified polyvinyl alcohol, partially saponified polyvinyl alcohol, carboxy-modified polyvinyl alcohols, acetoacetyl-modified polyvinyl alcohols, diacetone-modified polyvinyl alcohols, silicone-modified polyvinyl alcohols, and like polyvinyl alcohols; styrene-maleic anhydride copolymers and alkali salts thereof, isobutylene-maleic anhydride copolymers and alkali salts thereof, casein, gelatin, vinyl acetate resin latexes, urethane resin latexes, styrene-butadiene copolymer latexes, acrylic resin latexes, and the like.

A protective layer can be formed, usually in water serving as a medium, by applying to the heat-sensitive recording layer a coating composition obtained by mixing and stirring the above-mentioned binders, and pigments and auxiliaries to be added as necessary, and then drying.

Examples of such pigments include calcium carbonate, zinc oxide, aluminum oxide, titanium dioxide, amorphous silica, aluminium hydroxide, barium sulfate, talc, kaolin, clay, calcined kaolin, and like inorganic pigments; and nylon resin fillers, urea-formalin resin fillers, raw starch particles, and like organic pigments.

The amount of pigment is not limited, and is preferably about 5 to 80 mass %, and more preferably about 10 to about 60 mass %, of the total solids amount of the protective layer.

Examples of auxiliaries include zinc stearate, calcium stearate, polyethylene wax, carnauba wax, paraffin wax, ester wax, and like lubricants; sodium alkylbenzenesulphonates, sodium dioctylsulfosuccinate, sulfone-modified polyvinyl alcohols, sodium polyacrylate, and like surfactants; glyoxal, boric acid, dialdehyde starch, methylolurea, epoxy-based compounds, hydrazine-based compounds, and like insolubilizers (crosslinking agents); ultraviolet absorbers, fluorescent dyes, coloring dyes, release agents, antioxidants, etc. The amounts of such auxiliaries can suitably be selected from a wide range.

The coating method for the coating composition for forming the protective layer is not limited, and can employ known means such as air knife coating, Vari-Bar blade coating, pure blade coating, rod blade coating, short-dwell coating, curtain coating, dye coating, and the like.

The amount of the coating composition forming such a protective layer may be about 0.5 to about 3 g/m$^2$, and preferably about 0.8 to about 2 g/m$^2$, on a dry weight basis.

Heat-sensitive Recording Material

The heat-sensitive recording material of the present invention is obtained by applying the heat-sensitive recording layer coating composition to one or both sides of a substrate, and drying the composition. The heat-sensitive recording material may be produced, as desired, by applying the protective layer coating composition to the heat-sensitive recording layer, and drying the composition.

Usable substrates can be selected as necessary from papers (acid-free papers, acid papers), plastic films, synthetic papers, nonwoven fabrics, metal deposited materials, and the like.

When a heat-sensitive recording material provided with an undercoat layer is produced, the coating composition for forming an undercoat layer is applied to the substrate and dried to form the undercoat layer, on which a heat-sensitive recording layer may be subsequently provided.

The heat-sensitive recording material of the present invention has good water resistance, printability, anti-sticking properties, and anti-scuffing properties, and further has outstanding recording sensitivity.

In particular, the heat-sensitive recording material of the present invention is particularly advantageous when no protective layer is provided.

Without providing the protective layer, a heat-sensitive recording material of high productivity, and further having outstanding recording sensitivity can be obtained.

A protective layer is generally provided with the purpose of improving water resistance, anti-sticking properties, printability, anti-scuffing properties, etc., however the heat-sensitive recording material of the present invention is significant in having such properties without a protective layer.

Various known techniques used in the field of production of heat-sensitive recording materials can be applied as necessary to the present invention, and such techniques include smoothing treatments such as supercalendaring after formation of any or all layers, providing as necessary on the backside of the substrate a protective layer, a coating layer for printing, a magnetic recording layer, an antistatic layer, a heat-transfer recording layer, an inkjet recording layer, etc., treating the backside of the substrate with an adhesive to produce adhesive labels, perforating the heat-sensitive recording material, etc. Further, the heat-sensitive recording layer of the heat-sensitive recording material can also be made in a configuration such that multi color imaging is feasible.

EXAMPLES

The present invention is specifically described with reference to examples and comparative examples below, but is, of course, not limited to these examples.

"Parts" and "%" in the examples indicate mass parts and mass %, respectively, unless otherwise states.

Solubility parameters in the examples were calculated using the following formula, in accordance with Journal of Technology Coatings VOL. 55, No. 696, pages 100-101.

$$\delta=[(\Sigma\Delta e_i)(X)/(\Sigma\Delta v_i)(X)]^{0.5} \quad \text{[Formula 2]}$$

($\delta$: solubility parameter, X: molar fraction of monomers used for polymerization, $\Delta e_i$: energy of vaporization of each monomer, $\Delta v_i$ molar volume)

Further, a copolymer resin emulsion was applied to an aluminium foil such that an film thickness of about 50 μm after drying was attained, and dried (60° C., 5 hours) to obtain a copolymer resin film, of which the glass transition temperature was measured using a differential thermal analyzer (Seiko Instruments Inc.).

Example 1

(1a) Preparation of Dispersion A (Leuco Dye Dispersion)

A composition consisting of 20 parts of 3-di(N-butyl) amino-6-methyl-7-anilinofluoran, 5 parts of a 5% aqueous solution of methyl cellulose, and 15 parts of water was pulverized with a sand mill until an average particle diameter of 1.0 μm was attained.

(1b) Preparation of Dispersion B (Dispersion of Developer)

A composition consisting of 20 parts of 1,1-bis(4-hydroxyphenyl)-1-phenylethane, 5 parts of a 5% aqueous solution of methyl cellulose, and 15 parts of water was pulverized with a sand mill until an average particle diameter of 1.0 μm was attained.

(1c) Preparation of Heat-sensitive Recording Layer Coating Composition

A composition consisting of 60 parts of a 50% dispersion of kaolin (trade name: UW-90, manufactured by Engelhard Corporation), 20 parts of Dispersion A, 50 parts of Dispersion B, 13 parts of an aqueous dispersion of zinc stearate (trade name: Hydrin Z-7-30, solid content 31.5%, CHUKYO YUSHI, CO., Ltd.), 80 parts of a copolymer resin (copolymer components:(meth)acrylonitrile/alkyl (meth)acrylates/2-hydroxyethyl (meth)acrylate/(meth)acrylates/(meth)acrylamide, total content of (meth)acrylates: 5 mass % of the total mass of the copolymer resin, solubility parameter: 12.8, glass transition temperature: 50° C., average particle diameter: 230 nm) emulsion (trade name: OT1043Z-1, a solids concentration of 25%, Mitsui Chemicals, Inc.), and 40 parts of a 10% aqueous solution of completely saponified polyvinyl alcohol (trade name: PVA117, polymerization degree 1700, manufactured by Kuraray Co.,Ltd.) was stirred and mixed to obtain a heat-sensitive recording layer coating composition.

(1d) Production of Heat-sensitive Recording Material

The heat-sensitive recording layer coating composition prepared in (1c) above was applied to one side of a wood free paper (acid-free paper) weighing 64 g/m$^2$ so that the composition was 5 g/m$^2$ after drying, and dried to form a heat-sensitive recording layer, followed by subjecting the layer to a supercalendaring treatment to obtain a heat-sensitive recording material.

Example 2

A heat-sensitive recording material was obtained in the same manner as in Example 1, with the exception of using 10 parts of a low molecular weight polyethylene emulsion (trade name: Chemipearl W400 melting point 110° C., average particle diameter 4 μm, a solids concentration of 40%, manufactured by Mitsui Chemical, Inc.) in place of the aqueous dispersion of zinc stearate used in the heat-sensitive recording layer coating composition.

Example 3

A heat-sensitive recording material was obtained in the same manner as in Example 1, except for using 40 parts of 10% aqueous solution of a silicone-modified polyvinyl alcohol (trade name: R-1130, polymerization degree 1700, manufactured by Kuraray Co.,Ltd.) in place of the completely saponified polyvinyl alcohol, and 10 parts of a low molecular weight polyethylene emulsion (trade name: Chemipearl W400, melting point 110° C., average particle diameter 4 μm, a solids concentration of 40%, manufactured by Mitsui Chemical, Inc.) in place of the aqueous dispersion of zinc stearate used in the heat-sensitive recording layer coating composition.

Example 4

(4a) Preparation of Undercoat Layer Coating Composition

To obtain an undercoat layer coating composition was stirred and mixed a composition consisting of 60 parts of a 30% dispersion liquid of calcined kaolin (trade name: Ansilex, manufactured by Engelhard Corporation, oil absorption 90 ml/100 g, average particle diameter: 0.6 μm), 10 parts of 10% aqueous solution of completely saponified polyvinyl alcohol (trade name: PVA117, polymerization degree 1700, manufactured by Kuraray Co.,Ltd.), and 10 parts of SBR latex (trade name: L-1571, a solids concentration of 48%, manufactured by Asahi Kasei Corporation).

(4b) Preparation of Heat-sensitive Recording Material

A heat-sensitive recording material was obtained in the same manner as in Example 3, with the exception that an undercoat layer was provided by applying and drying the above (4a) undercoat layer coating composition between the substrate and the heat-sensitive recording layer so that the amount of applied coating composition was 10 g/m$^2$ after drying.

Example 5

A heat-sensitive recording material was obtained in the same manner as in Example 3 with the exception of using a low molecular weight polyethylene emulsion (trade name: SN coat 287, melting point 80° C., average particle diameter 0.2 μm, a solids concentration of 40%, manufactured by SAN NOPCO LIMITED) in the heat-sensitive recording layer coating composition in place of the low molecular weight polyethylene emulsion (trade name: Chemipearl W400) described earlier.

Example 6

A heat-sensitive recording material was obtained in the same manner as in Example 3 with the exception of using a low molecular weight polyethylene emulsion (trade name: Hydrin P-7, melting point 54° C., average particle diameter 0.85 μm, a solids concentration of 30%, manufactured by CHUKYO YUSHI CO., LTD.) in the heat-sensitive recording layer coating composition in place of the low molecular weight polyethylene emulsion (trade name: Chemipearl W400) described earlier.

Example 7

A heat-sensitive recording material was obtained in the same manner as in Example 1 with the exception that the amount of the copolymer resin emulsion in the heat-sensitive recording layer coating composition was changed to 450 parts.

Example 8

A heat-sensitive recording material was obtained in the same manner as in Example 1 with the exception that the amount of the 10% aqueous solution of completely saponified polyvinyl alcohol in the heat-sensitive recording layer coating composition was changed to 5 parts.

Example 9

A heat-sensitive recording material was obtained in the same manner as in Example 1 with the exception that 50 parts of a 20% aqueous solution of completely saponified polyvinyl alcohol (trade name: PVA105, polymerization degree 500, manufactured by Kuraray Co.,Ltd.) was used in the heat-sensitive recording layer coating composition in place of the completely saponified polyvinyl alcohol (trade name: PVA117) described earlier.

Example 10

A heat-sensitive recording material was obtained in the same manner as in Example 1 with the exception that completely saponified polyvinyl alcohol was not used in the heat-sensitive recording layer coating composition.

Example 11

A heat-sensitive recording material was obtained in the same manner as in Example 1 with the exception that 2 parts of an aldehyde compound (trade name: Glyoxal, a solids concentration of 40%) was added as a crosslinking agent to the heat-sensitive recording layer coating composition.

Comparative Example 1

A heat-sensitive recording material was obtained in the same manner as in Example 1 with the exception that 40 parts of a styrene-butadiene-based latex (trade name: L-1571, a solids concentration of 48%, solubility parameter: 8.4, manufactured by Asahi Kasei Corporation) was used in the heat-sensitive recording layer coating composition in place of the copolymer resin emulsion (trade name: OT1043Z-1) described earlier.

Comparative Example 2

A heat-sensitive recording material was obtained in the same manner as in Example 1 with the exception that 38 parts of a copolymer resin emulsion (trade name: AM2250, a solids concentration of 52%, manufactured by SHOWA HIGH-POLYMER CO., LTD.) having a solubility parameter of 10.56 was used in the heat-sensitive recording layer coating composition in place of the copolymer resin emulsion (trade name: OT1043Z-1) described earlier.

Comparative Example 3

A heat-sensitive recording material was obtained in the same manner as in Example 1 with the exception of using 240 parts of an aqueous solution of completely saponified polyvinyl alcohol (trade name: PVA117 as described earlier) in the heat-sensitive recording layer coating composition in place of the copolymer resin emulsion (trade name: OT1043Z-1) described earlier.

Comparative Example 4

(4a') Preparation of Protective Layer Coating Composition

To obtain a protective layer coating composition was stirred and mixed a composition consisting of 65 parts of a 50% dispersion liquid of kaolin (trade name: UW-90) described earlier, 8 parts of a low molecular polyethylene emulsion (trade name: Chemipearl W400 as described earlier), and 260 parts of a copolymer resin emulsion (trade name: OT1043Z-1) described earlier.

(4b') Preparation of Heat-sensitive Recording Material

The heat-sensitive recording layer coating composition prepared in Comparative Example 1 was applied to one side of a wood free paper (acid-free paper) weighing 64 g/m$^2$ so that the amount of composition applied was 5 g/m$^2$ after drying, and dried to form a heat-sensitive recording layer. The protective layer coating composition of the above (4a') was subsequently applied so that the amount of composition applied was 3 g/m$^2$ after drying, and dried to form a protective layer, which was then subjected together with the recording layer to a supercalendaring treatment to obtain a heat-sensitive recording material.

Evaluation

The thus-obtained 15 types of heat-sensitive recording materials were evaluated for the properties below, and the results are shown in Table 1.

1. Water Resistance

The heat-sensitive recording material was immersed in water for 5 seconds, and immediately after removing it from water the surface of the heat-sensitive recording layer was rubbed 10 times with a finger to evaluate the surface conditions.

B: No change occurred.

C: Surface slightly changed, but no practical inconvenience caused

E: Heat-sensitive recording layer distinctly came off

2. Printability

Printability was evaluated based on ink density (ink receptibility) and ink density homogeneity (uniformity of the print) transferred onto the heat-sensitive recording material, which was subjected to offset printing at 100 m/min. for 10 minutes using four ink colors (T&K RNC process, manufactured by T&K TOKA CO.,LTD) in an offset press (model: MVF-18B, manufactured by Miyakoshi Printing Machinery Co., Ltd).

B: Particularly excellent printability

C: Excellent printability

E : Poor printability

3. Anti-scuffing Properties

The heat-sensitive recording layer surface of heat-sensitive recording material was scratched with a spatula (tight plate-type, SUS410) to evaluate color forming levels. A color is formed by heat of the scratch, however little heat is generated if the layer surface is resistant to scratching (rubbing), thereby forming no color.

B: No color was formed

C: Color formed to a slight degree at no practically inconvenient level

D: Color formed at a level causing practical problems

E: Color was formed intensively

4. Recording Density

A heat-sensitivity evaluator (trade name: TH-PMD, product of OKURA DENKI) was used to record on the heat-sensitive recording layer surface of each heat-sensitive recording material with 0.24 mJ/dot of applied energy and 25 V of applied voltage. The density of the recorded portions was measured with a Macbeth densitometer (product name: RD-914, product of Macbeth LLC) in visual mode.

5. Anti-sticking Properties

A test pattern was recorded on a heat-sensitive recording material at an energy level of A3 and a rate of 4 inches/sec. using a heat-sensitivity evaluator (trade name: FR410 TASSHA, manufactured by SATO CORPORATION), and the degree of sticking occurred was evaluated in terms of printing sound and printed surface.

A: Substantially no printing sound caused by sticking, and the printed surface was not affected B: Faint printing sound caused by sticking was heard, but the printed surface was not affected D: Printing sound caused by sticking was loud, and the printed surface had some white lines E: Printing sound caused by sticking was intense, and the printed surface had many white lines 6. Yellowing The heat-sensitive recording materials were allowed to stand at 40° C. and 50% RH for a month, and the surface condition of each was observed.

B: Condition was maintained intact

D: Surface slightly changed from the intact condition at a level of no practical inconvenience.

E: Major changes occurred.

TABLE 1

| | Water resistance | Printability | Anti-scuffing properties | Recording sensitivity | Anti-sticking properties | Yellowing |
|---|---|---|---|---|---|---|
| Ex. 1 | C | B | C | 1.31 | B | B |
| Ex. 2 | C | B | B | 1.33 | A | B |
| Ex. 3 | B | B | B | 1.30 | A | B |
| Ex. 4 | B | B | B | 1.41 | A | B |
| Ex. 5 | B | B | B | 1.32 | A | B |

TABLE 1-continued

| | Water resistance | Printability | Anti-scuffing properties | Recording sensitivity | Anti-sticking properties | Yellowing |
|---|---|---|---|---|---|---|
| Ex. 6 | B | B | C | 1.31 | B | B |
| Ex. 7 | B | B | C | 0.95 | B | B |
| Ex. 8 | B | C | C | 1.31 | B | B |
| Ex. 9 | C | C | C | 1.32 | B | B |
| Ex. 10 | B | C | C | 1.35 | B | B |
| Ex. 11 | B | B | C | 1.30 | B | D |
| Co. Ex. 1 | E | E | D | 1.32 | E | B |
| Co. Ex. 2 | E | E | C | 1.31 | D | B |
| Co. Ex. 3 | E | E | E | 1.36 | D | B |
| Co. Ex. 4 | B | B | B | 0.81 | A | B |

The invention claimed is:

1. A heat-sensitive recording material comprising a substrate and a heat-sensitive recording layer, the heat-sensitive recording layer containing a leuco dye, a developer, and a copolymer resin emulsion, the copolymer resin emulsion comprising a copolymer resin, the copolymer resin (1) containing (I) (meth)acrylonitrile, and (ii) one or more vinyl monomers copolymerizable with (meth)acrylonitrile, (2) having a solubility parameter of 12.0 or higher, and (3) having a glass transition temperature exceeding 30° C. but equal to or less than 100° C., wherein the above mentioned vinyl monomers (ii) include at least a carboxyl group-containing vinyl monomer, and said at least a carboxyl group-containing vinyl monomer is 1 to 10 mass % of the total mass of the copolymer resin.

2. A heat-sensitive recording material of claim 1, wherein the solids content of the copolymer resin emulsion after drying is 10 to 50 mass % of the entire solids content of the heat-sensitive recording layer.

3. A heat-sensitive recording material of claim 1, wherein the heat-sensitive recording layer further comprises a polyolefin polymer resin emulsion contained in a solids content after drying of 0.5 to 15 mass % of the entire solids content of the heat-sensitive recording layer.

4. A heat-sensitive recording material of claim 3, wherein the polyolefin polymer resin constituent of the polyolefin polymer resin emulsion has a melting point of 70° C. or higher.

5. A heat-sensitive recording material of claim 1, wherein the heat-sensitive recording layer does not contain any crosslinking agent.

6. A heat-sensitive recording material of claim 1, wherein no protective layer is provided on the heat-sensitive recording layer.

7. A heat-sensitive recording material of claim 1, wherein the heat-sensitive recording layer further comprises a polyvinyl alcohol with a polymerization degree of 1000 or higher.

8. A heat-sensitive recording material of claim 7, wherein the polyvinyl alcohol is a silicone-modified polyvinyl alcohol.

9. A heat-sensitive recording material of claim 7, wherein the polyvinyl alcohol is 1 to 10 mass % of the entire solids content of the heat-sensitive recording layer.

* * * * *